US006364322B1

(12) United States Patent
Lee

(10) Patent No.: US 6,364,322 B1
(45) Date of Patent: Apr. 2, 2002

(54) WHEEL LOCK RELEASER ARRANGEMENT FOR ROLLER SKATE SHOE

(76) Inventor: Billy Lee, 6th Fl., No. 76, Tun Hua South Road, Sec. 2, Taipei (TW)

( * ) Notice: Subject to any disclaimer, the term of this patent is extended or adjusted under 35 U.S.C. 154(b) by 0 days.

(21) Appl. No.: 09/798,056

(22) Filed: Mar. 1, 2001

(51) Int. Cl.[7] ..... A63C 17/20
(52) U.S. Cl. ..... 280/11.27; 36/115; 280/7.13
(58) Field of Search ..... 280/7.13, 11.233, 280/11.25, 11.27, 11.28, 11.19, 11.223, 11.26; 36/115

(56) References Cited

U.S. PATENT DOCUMENTS 3,884,485 A * 5/1975 Walle ..... 280/11.233
3,979,842 A * 9/1976 Texidor ..... 36/115
3,983,643 A * 10/1976 Schreyer ..... 36/115
4,333,249 A * 6/1982 Schaefer ..... 36/115
5,785,327 A * 7/1998 Gallant ..... 280/11.233
5,797,609 A * 8/1998 Fichepain ..... 280/11.27
6,120,039 A * 9/2000 Clementi ..... 280/11.233
6,247,708 B1 * 6/2001 Hsu ..... 280/7.13

* cited by examiner

*Primary Examiner*—Michael Mar
(74) *Attorney, Agent, or Firm*—Raymond Y. Chan; David and Raymond Patent Group

(57) ABSTRACT

A roller skate shoe incorporates a wheel lock releaser arrangement which includes a locking member movably attached to a shaft for locking up a wheel frame from being slid rotatably with respect to a supporting frame of the roller skate shoe. The locking member includes an operation button extended to an exterior of a shoe base for operating the locking member. A resilient member is adapted for applying an urging pressure against the locking member so as to normally retain the locking member in a locking position. At the locking position, the locking member is engaged with the wheel frame such that the wheel frame is locked for a rotational movement. For operating the roller skate shoe, a player must press the operation button inwardly to disengage the locking member with the wheel frame, so as to unlock the wheel frame from being slid out of the receiving cavity.

3 Claims, 8 Drawing Sheets

WHEEL LOCK RELEASER ARRANGEMENT FOR ROLLER SKATE SHOE

BACKGROUND OF THE PRESENT INVENTION

1. Field of Invention

The present invention relates to a roller skate shoe, and more particularly to a wheel lock releaser arrangement for roller skate shoe, wherein the wheel lock releaser arrangement normally locks up a wheel frame of the roller skate shoe in a rotatably manner so as to prevent the wheel frame from being slid unintentionally and accidentally.

2. Description of Related Arts

Nowadays, roller skates are well known and have been considered as a formed of transportation, recreation, and exercise. Conventional roller skates each comprises a roller device permanently installed thereunder such that a player must carry an extra pair of shoe for interchange purpose, which is a hassle for the player.

As shown in FIG. 1, an improved pair of roller skate shoes is adapted for solving the above problem. Each roller skate shoe comprises a base 1A having two chambers 10A provided thereon and two roller devices 2A foldably received in the chambers 10A respectively in such a manner that the roller device 2A is folded into the chamber 10A for storage and unfolded out of the chamber 10A for usage. So, the player does not have to carry an extra pair of shoes everywhere. Each roller device 2A comprises an U-shaped supporting frame 21A under the base 1A of the roller skate shoe within the chamber 10A comprising a shaft 211A transversely mounted on the supporting frame 21A, and an U-shaped wheel frame 22A rotatably mounted on the shaft 211A comprising a wheel axle 221A transversely mounted on the wheel frame 22A wherein a wheel 222A is rotatably supported on the wheel axle 221A in such a manner that the wheel frame 22A is adapted for rotatably folding in the chamber 10A for storage purpose and rotatably folding out of the chamber 10A for use.

Such roller skate shoe further comprises locking means 23A mounted on the shaft 211A of the supporting frame 21A for locking the wheel frame 22A in position. The locking means 23A comprises a locker arm 231A slidably mounted on the shaft 211A of the supporting frame 21A wherein the locker arm 231A has a locking tip 2311A for blocking a rotational movement of the wheel frame 22A by the supporting frame 21A, and a compression spring 24A, which is coaxially mounted on the shaft 211A, having two ends biasing against the locker arm 231A and the wheel frame 22A for urging and retain the locker arm 231A in a locking position. In order to use the roller skate shoe, the player must use his or hand to pull the wheel frame 22A out of the chamber 10A in a rotatably movable manner until the locking tip 2311A of the locker arm 231A slid out of the supporting frame 21A so as to lock up the wheel frame 22A in position. For unlocking the wheel frame 22A, the player must use his or her hand again to push the locker arm 231A aside until the locking tip 2311A is moved away from the supporting frame 21A and then push the wheel frame 22A back into the chamber 10A.

While the foregoing disclosure of the conventional roller skate shoes, the shoes have several drawbacks. Each roller device 2A must have a relative larger size in order to rigidly support a downward force which is the weight of the player. In other words, the roller device 2A requires a bigger chamber 10A, especially the depth thereof, to fittedly store the roller device 2A therein such that the shoe must be increase its size and weight, which is an unreasonable afford for the player especially for a young child.

Thus, since the contacting area of the shoe is between the wheel 222A and the ground, the size of the wheel 222A is a main factor for stable manner. However, the wheel frame 22A can only carry one wheel 222A such that when a bigger wheel 222A is used, the size of the wheel frame 22A must be bigger than the size of the wheel 222A, which will create the storage drawback as mentioned above. When a smaller wheel 222A is used, the young player may easily lose his or her balance so as to cause an unwanted injury to the young player. In fact, the U-shaped wheel frame 22A cannot provide a rigid structure for the wheel 222A supporting thereon so that the wheel frame 22A may be easily broken when an external force, such as a collusion force, exerted on the wheel frame 22A and cause major injury to the young player.

Moreover, the locking means 23A cannot securely hold the wheel frame 22A in order to prevent an unwanted rotational movement thereof. Since a coil spring 25A is used for retaining the wheel frame 22A rotatably sliding out of the chamber 10A, the locker arm 231A is also forced to push of the supporting frame 21A to lock up the wheel frame 22A as well. So, the wheel frame 22A may only be blocked to slide back to the chamber 10A until the locker arm 231A hits the supporting frame 21A such that an unwanted rotational movement of the wheel frame 22A will cause an unbalance of the roller skate shoe. Also, in the locked position, the locker arm 231A must be strong enough to bias against the rotating force of the wheel frame 22A. It is worth to mention that the rotating force will proportionally increase when the radially distance from the center is increased. In other words, the longer length of the locker arm 231A is, the greater rotational force of the locker arm 231A must be afforded. So, the locker arm 231A must be rigid enough to lock up the rotation of the wheel frame 22A.

Furthermore, the player must use his or her hand to pull out the wheel frame 22A and unlock the wheel frame 22A every time for use and storage respectively. It is a hassle for the player because the player must touch the wheel 222A even though the wheel 222A is dirty. Also, some players may have difficulties to bend down their body to fold and unfold the roller device 2A due to their physical abilities. They may merely take off their shoes to operate the folding and unfolding process. It is unreasonable that they have to take off their shoes every time, which is the same as the conventional roller skates.

SUMMARY OF THE PRESENT INVENTION

A main object of the present invention is to provide a wheel lock releaser arrangement for roller skate shoe for normally locking up a wheel frame of the roller skate shoe so as to prevent the wheel frame from being slid unintentionally and accidentally.

Another object of the present invention is to provide a wheel lock releaser arrangement for roller skate shoe which comprises a locking means for locking up a wheel frame in position wherein an operation button is provided on an outer surface of the shoe for unlocking the wheel frame. In other words, the player does not require his or her hands to touch the wheels in order to unlock the wheel frame.

Another object of the present invention is to provide a wheel lock releaser arrangement for roller skate shoe wherein the locking means locks up the wheel axle by means of engagement so as to minimize the rotational force exerted on the locking means. In other words, the locking means can securely lock up the roller device in position.

Another object of the present invention is to provide a wheel lock releaser arrangement for roller skate shoe wherein each roller arrangement of the roller skate shoes comprises a pair of wheels rigidly supported on a wheel axle for increasing a contacting area between the wheels and the ground so as to provide a stable manner for a player.

Another object of the present invention is to provide a wheel lock releaser arrangement for roller skate shoe wherein each roller arrangement has relative small size and shape so as to reduce the size and weight of the shoe, which can also minimize the cost of the shoe as well.

Accordingly, in order to accomplish the above objects, the present invention provides a wheel lock releaser arrangement for roller skate shoe, which comprises:

a shoe base having two receiving cavities provided thereunder at a front portion and a rear portion of the shoe base respectively wherein the shoe base has at least an operation through slot provided on a sidewall of each receiving cavity to communicate to an exterior of the shoe base;

a roller arrangement fittedly received in each receiving cavity comprising a supporting frame securely mounted on a ceiling of the receiving cavity, a wheel frame rotatably mounted on the supporting frame by a shaft, and a resilient element for applying an urging pressure against the wheel frame so as to normally retain the wheel frame slid out of the receiving cavity; and a wheel lock releaser arrangement for securely locking the wheel frame in a rotatably movable manner selectively between a folded position and an unfolded position wherein in the folded position, the wheel frame is rotatably slid into the receiving cavity and in the unfolded position, the wheel frame is rotatably slid out of the receiving cavity wherein the wheel releaser arrangement comprises:

a locking member movably attached to one end of the shaft for locking up the wheel frame from being slid rotatably with respect to the supporting frame wherein the locking member comprises an operation button extended to the exterior of the shoe base through the operation through slot for operating the locking member to move from a normally locking position to an unlocking position; and a resilient member which is disposed in the receiving cavity for applying an urging pressure against the locking member so as to normally retain the locking member in the locking position, wherein at the locking position, the locking member is engaged with the wheel frame in such a manner that the wheel frame is locked for rotational movement, and that in the unlocking position, the locking member is moved to disengage with the wheel frame so that the wheel frame is capably of being slid rotationally to fold and unfold the wheel frame.

DETAILED DESCRIPTION OF THE PREFERRED EMBODIMENT

Figure 1:
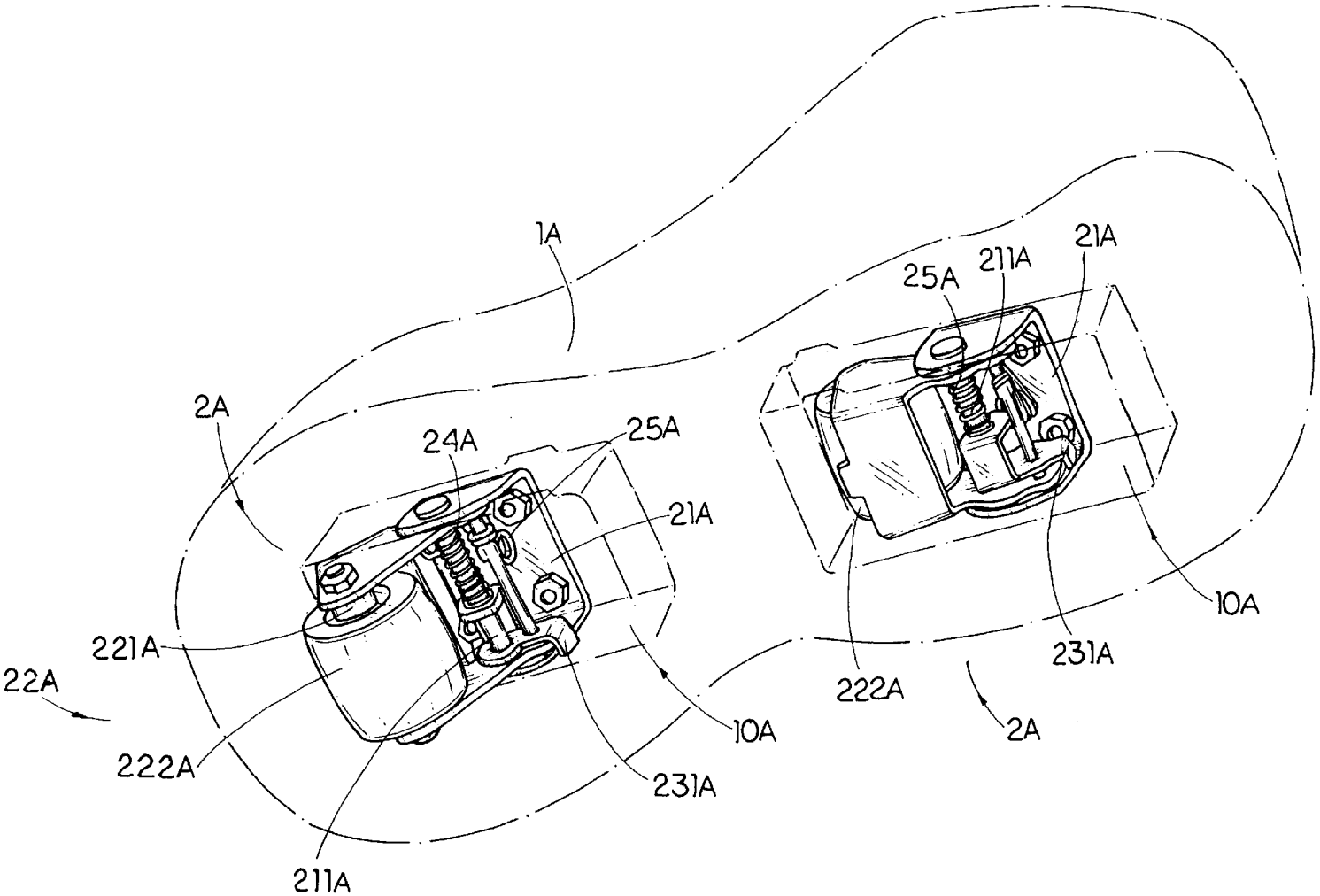
FIG 1 PRIOR ART
FIG. 1 is a perspective view of a conventional roller skate shoe.
Figure 2:
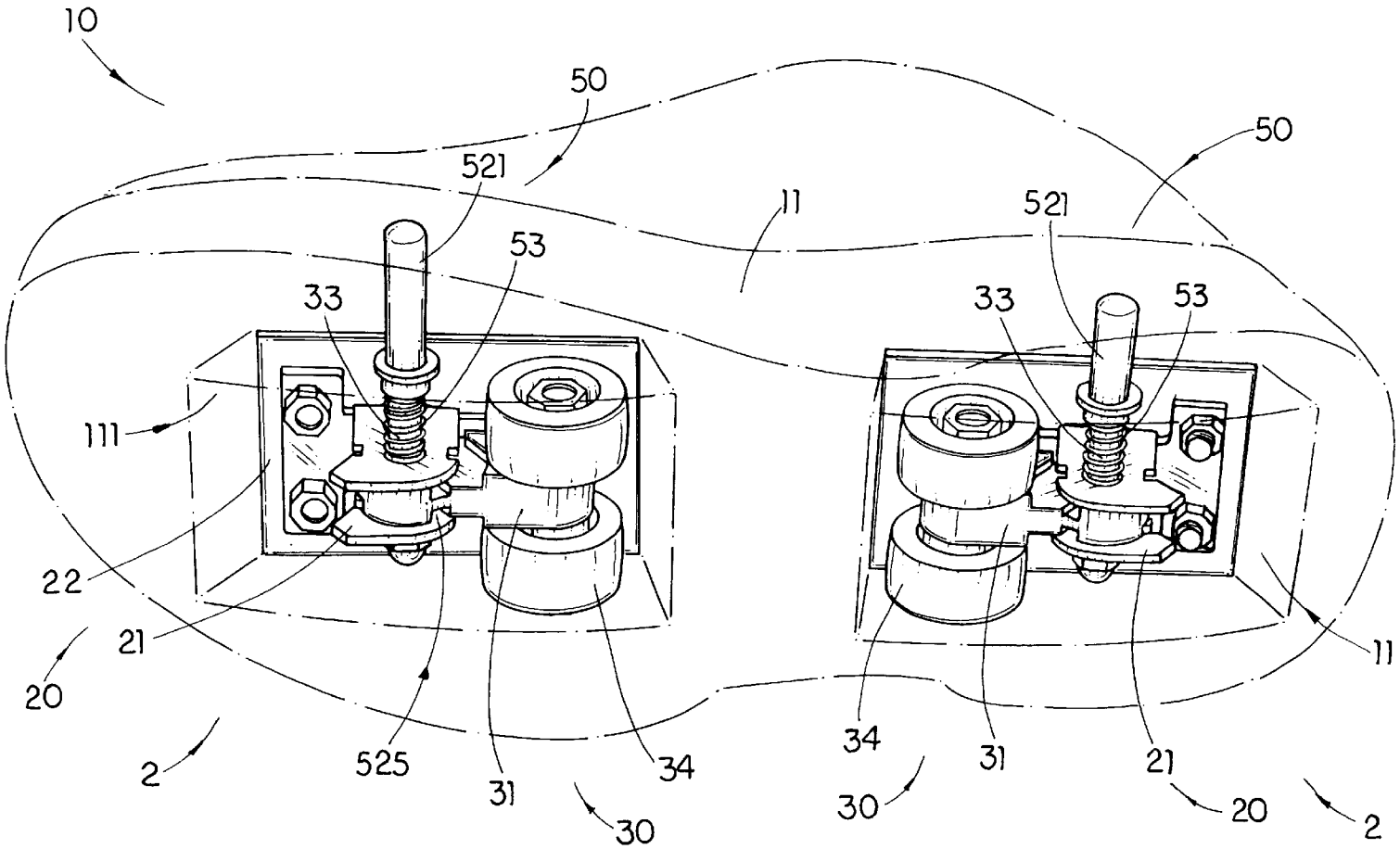
FIG. 2 is a perspective view of a roller skate shoe according to a preferred embodiment of the present invention.

Referring to FIG. 2 of the drawings, a roller skate shoe 10 according to a preferred embodiment of the present invention is illustrated. The roller skate shoe 10 comprises a shoe base 11 having two receiving cavities 111 provided thereunder at a front portion and a rear portion of the shoe base 11 respectively and a roller arrangement 2 fittedly received in each receiving cavity 111 of the shoe base 10.

Figure 3:
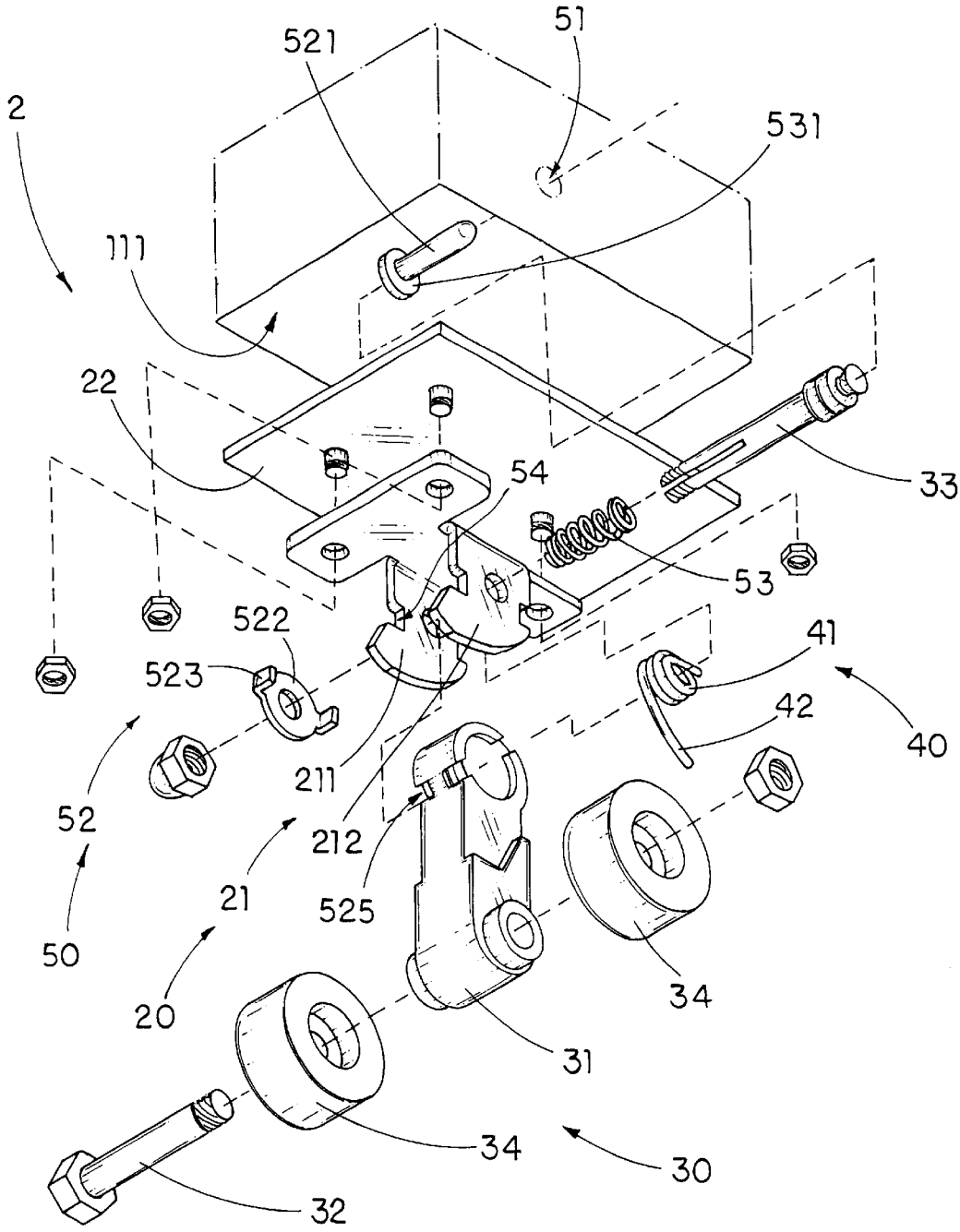
FIG. 3 is an exploded perspective view of a roller arrangement of the roller skate shoe according to the above preferred embodiment of the present invention.

As shown in FIG. 3, the roller arrangement 2 comprises a supporting frame 20 securely mounted on a ceiling of the receiving cavity 111 comprising a supporting member 21 extended downwardly, a T-shaped wheel frame 30 comprising a vertical wheel arm 31 rotatably mounted on the supporting member 21 of the supporting frame 20 by a shaft 33 and a horizontal wheel axle 32 for rotatably supporting two wheels 34 at two ends thereof, and a resilient element 40 which is disposed the wheel frame 30 for applying an urging pressure against the wheel frame 30 so as to normally retain the wheel frame 30 out of the receiving cavity 111 of the shoe base 11.

Figure 6:
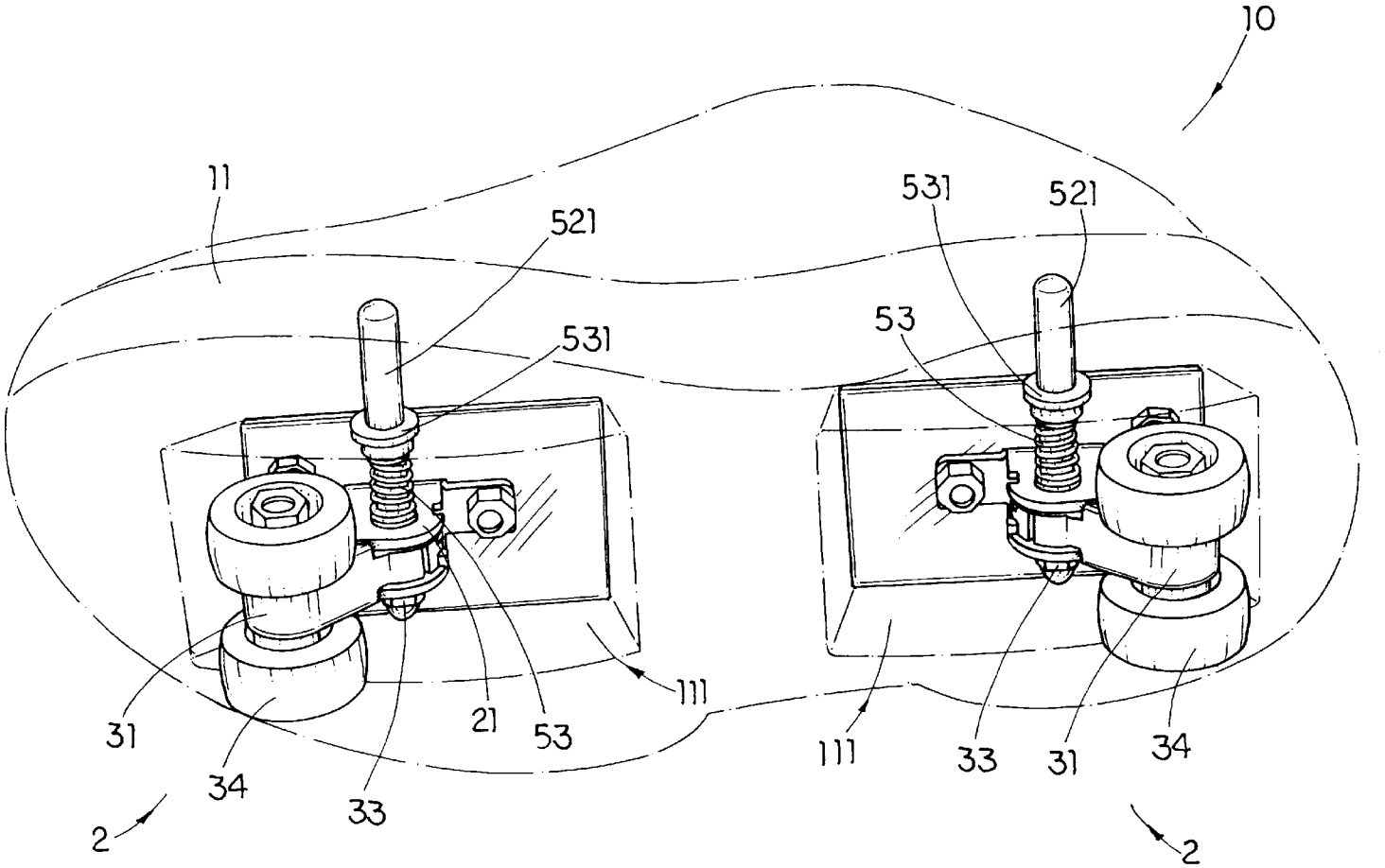
FIG. 6 is a perspective view of the roller skate shoe according to the above preferred embodiment of the present invention, illustrating the wheel frame being folded out of the receiving cavity.

The roller skate shoe 10 further comprises a wheel lock releaser arrangement 50 for securely locking the wheel frame 30 in a rotatably movable manner selectively between a folded position and an unfolded position wherein in the folded position as shown in FIG. 2, the wheel frame 30 is rotatably slid into the receiving cavity 111 and in the unfolded position as shown in FIG. 6, the wheel frame 30 is rotatably slid out of the receiving cavity 111 of the shoe base 11.

According to the preferred embodiment, the shoe base 11 of the roller skate shoe 10 has a predetermined shape and thickness such that the receiving cavity 111 has a predetermined depth adapted for fittedly receiving the roller arrangement 2 therein. It is worth to mention that when the wheel frame 30 is foldably received in the receiving cavity 111, the roller skate shoe 10 becomes a regular sport shoe and when the wheel frame 30 is foldably rotated out of the receiving cavity 111, the wheels 34 are rotatably exposed under the roller skate shoe 10 and function as a conventional roller skate.

The supporting frame 20 further comprises a rigid supporting panel 22 firmly mounted on the ceiling of the receiving cavity 111 of shoe base 10 so as to reinforce the shape of the receiving cavity 111 wherein the supporting member 21 is securely affixed to the supporting panel 22. Accordingly, the supporting member 21 comprises a pair of parallel supporting walls 211, 212 downwardly extended from the supporting panel 22.

The wheel arm 31 of the wheel frame 30 is rotatably mounted between the two supporting walls 211, 212 of the supporting member 21 by the shaft 33 in such manner that the wheel frame 30 is adapted for freely rotating from the receiving chamber to outside. The two wheels 34 are rotatably mounted on two outer ends of the wheel axle 32. Accordingly, the construction of the wheel frame 30 is rigid enough to support the wheels 34 thereon when a downward force which is the weight of the player is exerted on the entire roller skate shoe 10, such as the construction of the wheel assembly of the airplane.

The resilient element 40, according to the preferred embodiment, is a coil spring disposed in the wheel frame 30 for normally retaining and urging the wheel frame 30 in the unfolded position wherein the resilient element 40 has a coil body 41 coaxially affixed to the shaft 33 and at least one resilient arm 42 extended from the coil body 41 for biasing against the wheel arm 31. The resilient arm 42 of the resilient element 40 applies an urging force against the wheel frame 31 to push it outwardly until the wheel frame 30 is rotatably slid out of the receiving cavity 111, which is the unfolded position of the wheel frame 30.

The wheel lock releaser arrangement 50 has an operation through slot 51 provided on a sidewall of the receiving cavity 111 to communicate with an exterior of the shoe base 10, a locking member 52 for selectively engaging with the wheel arm 31 from being slid rotatably with respect to the supporting member 21, and a resilient member 53 for applying an urging pressure against the locking member 52 so as to retain the locking member 52 in a locking position.

According to the preferred embodiment, the operation through slot 51 is transversely formed on an inner sidewall of the receiving cavity 111 wherein the operation through slot 51 is coaxially aligning with the shaft 33 of the wheel frame 30.

The locking member 52 is movably attached to a side of the wheel frame 30 so as to lock up the wheel frame 30 on the supporting frame 20 in a rotatably movable manner, wherein the locking member 52 comprises an operation button 521 extended to the operation through slot 51 for operating the locking member 52 to move from a normally locking position to an unlocked position.

Figure 4:
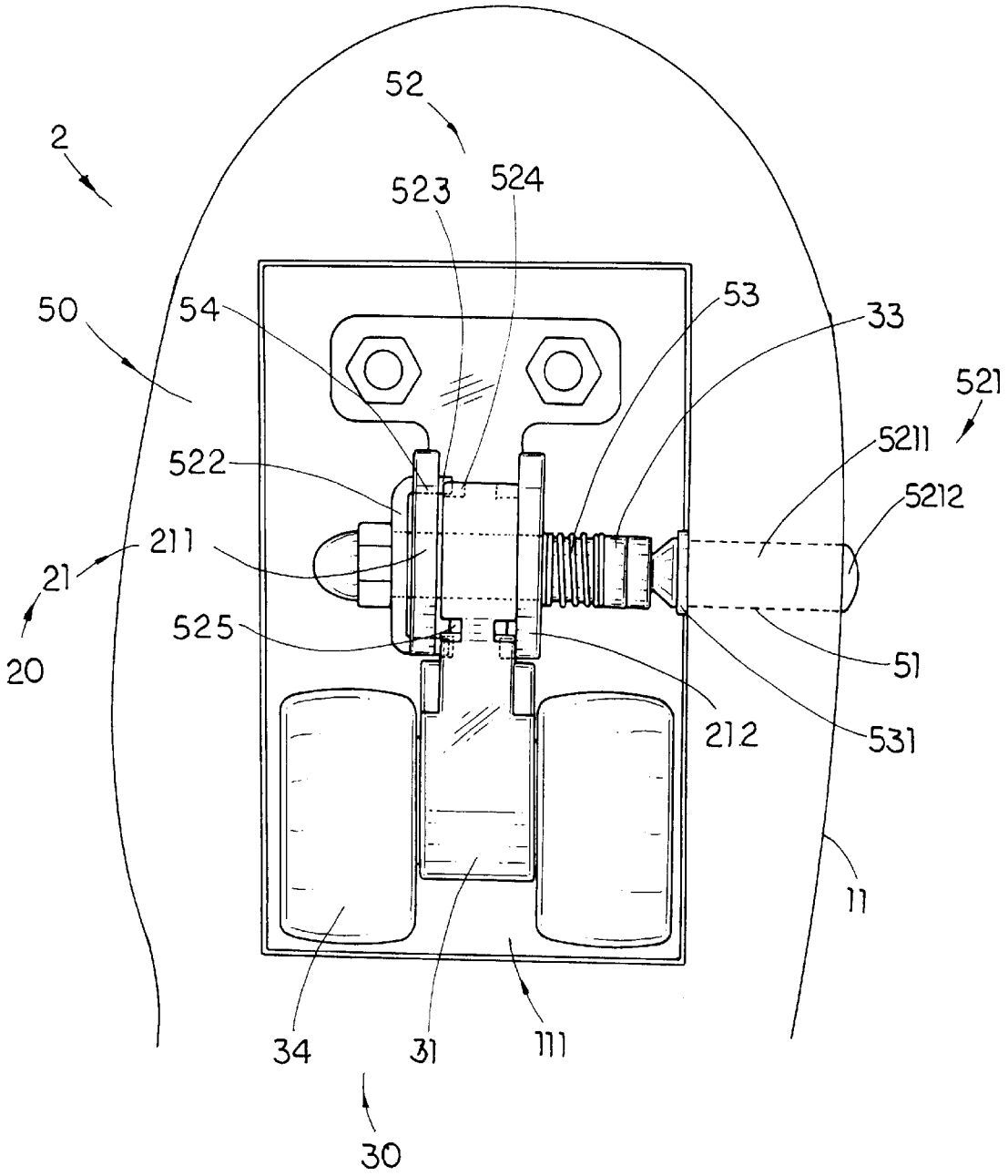
FIG. 4 is a side view of a wheel lock releaser arrangement of the roller skate shoe in a locked position according to the above preferred embodiment of the present invention.
Figure 5:
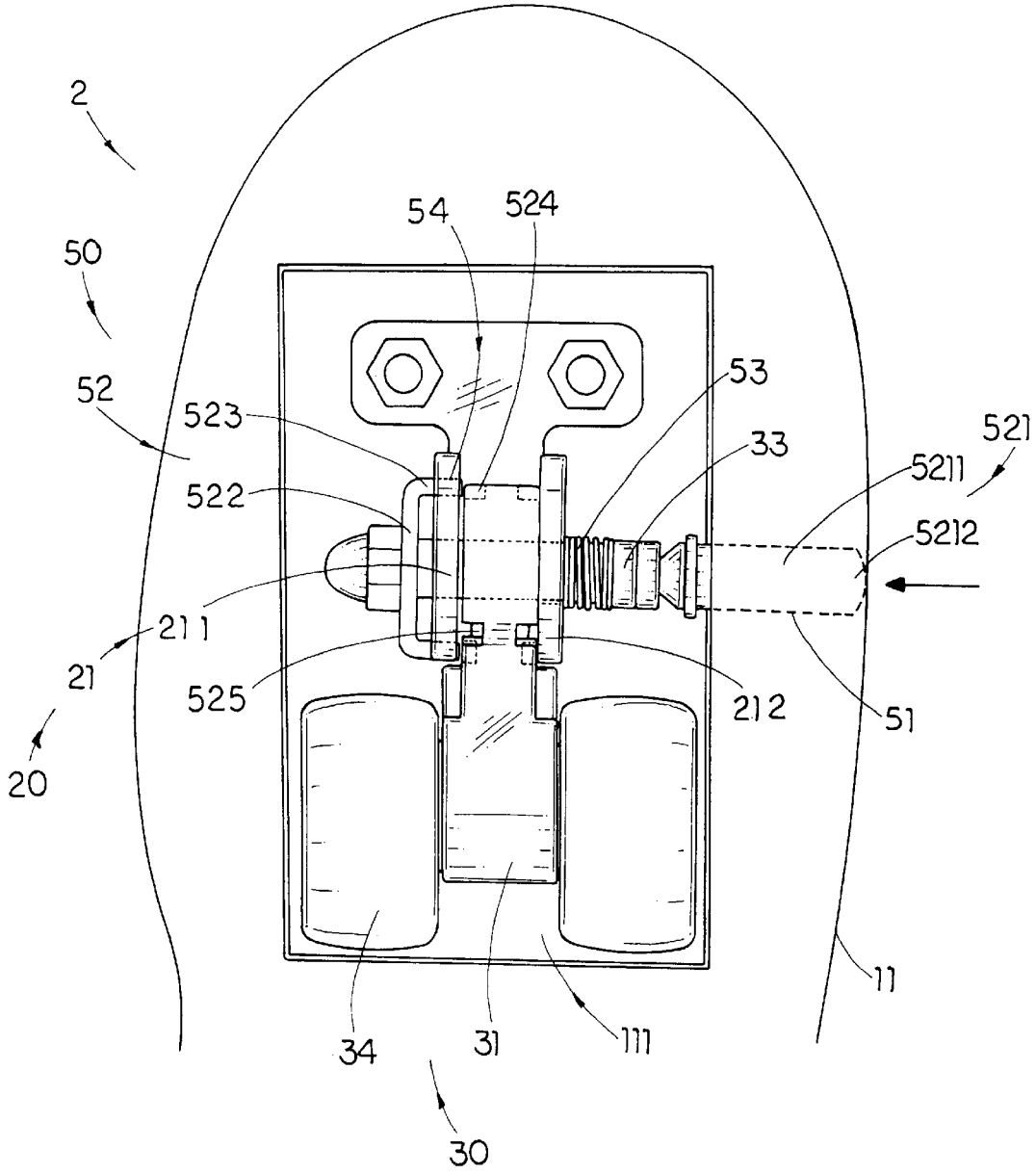
FIG. 5 is a side view of the wheel lock releaser arrangement of the roller skate shoe in an unlocked position according to the above preferred embodiment of the present invention.

Accordingly, in the locking position as shown in FIG. 4, the wheel frame 30 is locked for rotational movement by the engagement between the locking member 52 and the wheel frame 30 so as to lock up the wheel frame 30 on the supporting frame 20. In the unlocked position as shown in FIG. 5, the locking member 52 is moved to release the engagement between the locking member 52 and the wheel frame 30 so that the wheel frame 30 is capably of rotatably sliding into the receiving cavity 111, i.e. the folded position of the wheel frame 30, and out of the receiving cavity 111, i.e. the unfolded position of the wheel frame 30.

The locking member 52 further comprises a locker cap 522 having at least a locking flange 523 integrally therefrom wherein the locker cap 522 is coaxially attached to an outer end of the shaft 33 and positioned adjacent to the respective supporting wall 211. Two locker grooves 524, 525 are transversely formed on the wheel arm 31 respectively wherein the locking flange 523 is engaged with one of the locker grooves 524 in the folded position of the wheel frame 30 while the locking flange 523 is engaged with another locker groove 525 in the unfolded position of the wheel frame 30. In other words, the wheel frame 30 is locked up by the engagement between the locking flange 523 and the locker grooves 524, 525 in both folded and unfolded positions, so as to prevent an unwanted rotational movement of the wheel frame 30.

The operation button 521 comprises an elongated button body 5211 extended from an inner end of the shaft 33 to the exterior of the shoe base 11 through the operation through slot 51 in a slidably movable manner and an enlarged button head 5212 provided on an inner side of an outer surface of the shoe base 11 in such a manner that when the button head 5212 of the operation button 521 is pressed in an inward manner, the locking flange 523 of the locker cap 522 is disengaged with the respective locker groove 524, 525 so as to unlock the rotational movement of the wheel frame 30.

The resilient member 53, which is a compression spring, is coaxially mounted on the button body 5211 of the operation button 521 wherein the resilient element 53 has one end biasing against the respective supporting wall 212 and the other end connected with a spring stopper 531 for biasing against the sidewall of the receiving cavity 111. The resilient member 53 normally applies an urging force against the operation button 521 to push it to the exterior of the shoe base 11 through the operation through slot 51 until the spring stopper 531 is stopped by the sidewall of the receiving cavity 111, wherein the locker cap 522 is pulled towards to the wheel frame 30 to engage the locking flange 523 with the respective locker groove 524, 525 and maintain in such a locking position that substantially blocks the rotational movement of the wheel frame 30. It is worth to mention that the wheel lock releaser arrangement 50 locks up the wheel frame 30 from the shaft 33 so as to minimize the rotational locking force exerted on the wheel lock releaser arrangement 50, so that the wheel lock releaser arrangement 50 can securely lock up the rotational movement of the wheel frame 30.

The wheel lock releaser arrangement 50 further has a guiding slot 54 provided on the respective supporting wall 211 of the supporting member 21 of the supporting frame 20 wherein the locking flange 523 is fitted in the guiding slot 54 so as to hold the locker cap 522 in position.

In order to unlock the roller skate shoe 10, an inward pushing force must be intentionally pressed on the button head 5212 of the operation button 521, so that the locker cap 522 is driven to move away from the wheel arm 31 through the shaft 33, so as to disengage the locking flange 523 with the respective locker groove 524. Then, the wheel frame 30 is automatically slid out of the receiving cavity 111 by the compressed resilient element 40 in a rotatably movable manner. While the pushing force is released, the compressed resilient member 53 will be rebounded to its original form which pushes the locker cap 522 back to its original locking position so that the locking flange 523 will then be engaged with the respective locker groove 525 to lock up the wheel frame 30 in the unfolded position.

For folding the wheel frame 30, the player simply applies the inward pushing force again on the operation button 521 to disengage the locking flange 523 of the locker cap 522 with the respective locker groove 524 and then rotatably press the wheel frame 30 back into the receiving cavity 111 until the locking flange 523 re-engaging with the respective locker groove 525 so as to lock up the wheel frame 30 in the folded position. It is worth to mention that since the player wears the roller skate shoe 10, the player can simply press down the roller skate shoe 10 in order to press the wheel frame 30 back into the receiving cavity 111 with respect to the ground. So, the player does not have to take off the roller skate shoe 10 in order to unfold the wheel frame 30 out of the receiving cavity 111 for use and fold the wheel frame 30 into the receiving cavity 111 for storage. Thus, in both locking and unlocking processes of the roller skate shoe 10, the player simply presses the operation button 521 to operate the roller skate shoe 10, so that the player does not require to use his or her hand in order to touch the wheel frame 30 at all.

Figure 7:
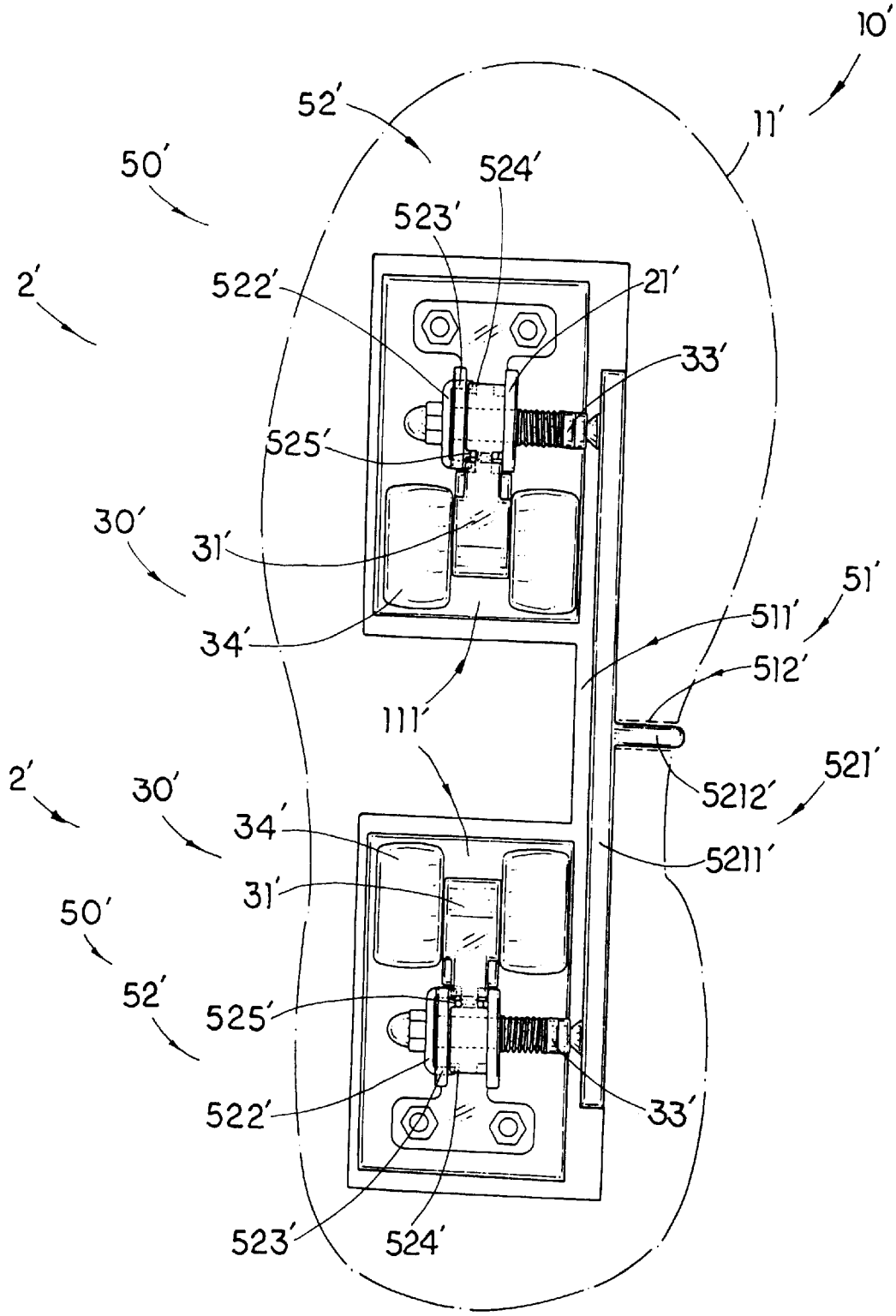
FIG. 7 illustrates a first alternative mode of the wheel lock releaser arrangement of the roller skate shoe of the above preferred embodiment of the present invention.

FIG. 7 illustrates a first alternative mode of the above preferred embodiment of the wheel lock releaser arrangement 50' of the present invention, wherein the operation button 521' of the locking member 52' is modified to provide on an inner side of the exterior surface of the shoe base 11' of the roller skate shoe 10' for operating two roller arrangements 2' at the same time instead of the operation button 521 for each roller arrangement 2 in the above preferred embodiment.

The wheel lock releaser arrangement 50' has a T-shaped operation through slot 51' having a vertical slot portion 511' provided between two receiving cavities 111' and a horizontal slot portion 512' extended from the vertical slot portion 511' of the operation through slot 51' to communication with an exterior of the inner side of the shoe base 11'.

The operation button 521' comprises an elongated button body 5211' movably extended between two inner ends of the shafts 33' of the two roller arrangements 2' of the roller skate shoe 10' through the horizontal slot portion 512' of the operation through As slot 51' and an elongated button head 5212' perpendicularly extended from the button body 5211' to the exterior of the shoe base 11' through the vertical slot portion 511' of the operation through slot 51' in a slidably movable manner.

In order to operate the wheel lock releaser arrangement 50', an inward force must be applied on the button head 5212' on the exterior of the shoe base 11' in such a manner that each of the shafts 33' is arranged to drive the respective locker cap 522' moved away from the wheel arm 31' of the wheel frame 30" through the button body 5211', so as to disengage the locking flange 523' with the respective locker grove 524', 525' on the wheel frame 30'.

It is worth to mention that the vertical slot portion 511' of the operation through slot 51' having a predetermined width is adapted for the button body 5211' laterally moving from the unlocking position to the locking position.

Figure 8:
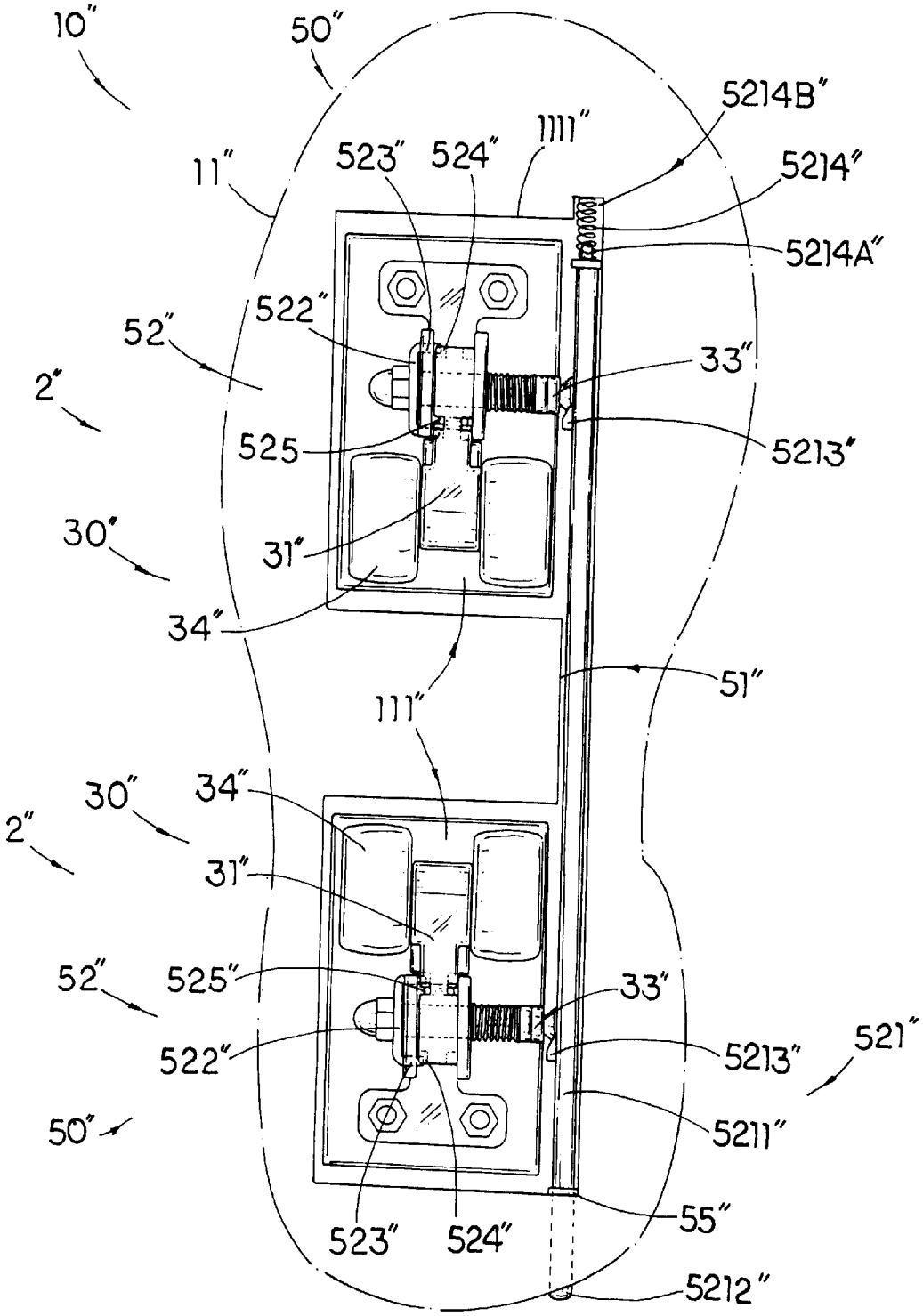
FIG. 8 illustrates a second alternative mode of the wheel lock releaser arrangement of the roller skate shoe of the above preferred embodiment of the present invention.

FIG. 8 illustrates a second alternative mode of the above preferred embodiment of the wheel releaser arrangement 50" of the present invention, wherein the operation button 521" of the locking member 52" is modified to provide a rear side of the exterior surface of the shoe base 11" of the roller skate shoe 10" for operating two roller arrangements 2" at the same time.

The wheel lock releaser arrangement 50" has an operation through slot 51" latitudinally provided between two receiving cavities 111" to communicate with an exterior of the shoe base 11" at a rear side thereof.

The operation button 521" comprises an elongation button 5211" slidably extended between two inner ends of the shafts 33" of the two roller arrangement 2" of the roller skate shoe 10" through the operation through slot 51" and an enlarged button head 5212" provided on the rear side of an outer surface of the shoe base 11".

The operation button 521" further comprises a pair of releasing hinges 5213" each having a sloping surface mounted on button body 5211" respectively wherein each releasing hinge 5213" is positioned adjacent to the inner end of the respective shaft 33", and a resilient unit 5214", which is a compression spring, mounted between the button body 5211" and an inner wall 1111" of the respective receiving cavity 111" by connecting one end with a spring holder 5214A" and the other end engaged in a holding hole 5214B" provided on the inner wall 1111" of the receiving cavity 111". The resilient unit 5214" normally applies an urging force against the operation button 521" to push the button head 5212" to the exterior of the shoe base 11".

The wheel lock releaser arrangement 50" further comprises at least a stopper 55" mounted on the button body 5211" for biasing against an inner sidewall of the receiving cavity 111" to block a further sliding movement of the button body 5211" along the operation through slot 51", so as to prevent the operation button 521" from being slid out of the shoe base 11".

In order to operate the wheel lock releaser arrangement 50", an inward force is applied on the button head 5212" on the rear side of the shoe base 11". Due to the sloping surface of the releasing hinge 5213", the respective shaft 33" is driven to move sideward until the locker cap 522" is moved away from the wheel arm 31" of the wheel frame 30", so as to disengage the locking flange 523" with the respective locker groove 524", 525".

What is claimed is:

1. A roller skate shoe, comprising:

a shoe base having two receiving cavities provided thereunder at a front portion and a rear portion of said shoe base respectively operation through slot extending longitudinally alongside a sidewall of each receiving cavity, the operation through slot having a rear opening to communicate to an exterior of said shoe base;

a roller arrangement fittedly received in each said receiving cavity comprising a supporting frame securely mounted on a ceiling of said receiving cavity, a wheel frame rotatably mounted on said supporting frame by a shaft, and a resilient element for applying an urging pressure against said wheel frame so as to normally retain said wheel frame in an unfolded position out of said receiving cavity; and a wheel lock releaser arrangement for securely locking said wheel frame in a rotatably movable manner selectively between a folded position and an unfolded position wherein in said folded position, said wheel frame is rotatably received into said receiving cavity and in said unfolded position, said wheel frame is rotatably extended out of said receiving cavity wherein said wheel releaser arrangement comprises:

a locking member movably attached to one end of said shaft for locking up said wheel frame from being rotatable with respect to said supporting frame wherein said locking member comprises an operation button having an elongated rod portion slidably received within said operation through slot, a button head portion extending through said rear opening to an exterior of said shoe base, and a pair of protruding members formed on said elongated rod portion, each protruding member having a sloping surface selectively engageable with an end of a respective shaft upon depression of said button head portion for operating said locking member to move from a normally locking position to an unlocking position; and a resilient member which is disposed in said receiving cavity for applying an urging pressure against said locking member so as to normally retain said locking member in said locking position, wherein at said locking position, said locking member is engaged with said wheel frame for locking said wheel frame against rotational movement, and that in said unlocking position, said locking member is moved to disengage with said wheel frame so that said wheel frame is rotatable between said folded and unfolded positions.

2. A roller skate shoe, as recited in claim 1, wherein said supporting frame comprising a supporting member extending downwardly from said ceiling of said receiving cavity and said wheel frame being T-shaped comprising a vertical wheel arm rotatably mounted on said supporting member of said supporting frame by said shaft and a horizontal wheel axle for rotatably supporting two wheels at two ends thereof.

3. A roller skate shoe, as recited claim 1, further comprising a compression spring, mounted between said elongated rod portion of said operation button and an inner wall of said respective receiving cavity, one end of said compression spring being connected with a spring holder and the other end being engaged in a holding hole provided on said inner wall of said receiving cavity wherein said compression spring applies an urging force against said operation button to push said button head to said exterior of said shoe base.

* * * * *